US009246278B1

(12) United States Patent
Dunwoody et al.

(10) Patent No.: US 9,246,278 B1
(45) Date of Patent: Jan. 26, 2016

(54) CONNECTOR MODULE WITH CABLE EXIT REGION GASKET

(71) Applicant: Tyco Electronics Corporation, Berwyn, PA (US)

(72) Inventors: Steven David Dunwoody, Middletown, PA (US); Richard James Long, Columbia, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/451,010

(22) Filed: Aug. 4, 2014

(51) Int. Cl.

| | |
|---|---|
| ***H01R 9/03*** | (2006.01) |
| ***H01R 13/6592*** | (2011.01) |
| ***H01R 13/6581*** | (2011.01) |
| ***H01R 13/6598*** | (2011.01) |

(52) U.S. Cl.
CPC ..... *H01R 13/6592* (2013.01); *H01R 13/6581* (2013.01); *H01R 13/6598* (2013.01)

(58) Field of Classification Search
USPC ..... 439/607.47, 607.49, 607.41, 607.48
See application file for complete search history.

(56) References Cited

U.S. PATENT DOCUMENTS

| | | | | |
|---|---|---|---|---|
| 3,990,830 | A * | 11/1976 | Slade | B05C 7/02 425/262 |
| 4,830,628 | A * | 5/1989 | Dyson | H01R 13/648 439/579 |
| 6,568,945 | B2 * | 5/2003 | Whybrow | H01R 13/65802 439/86 |
| 6,672,909 | B2 * | 1/2004 | Dewdney | H01R 13/65807 439/579 |
| 6,843,657 | B2 * | 1/2005 | Driscoll | H01R 23/688 439/289 |

* cited by examiner

*Primary Examiner* — Phuong Dinh

(57) ABSTRACT

A connector module includes a housing, a cable, and a gasket. The housing is defined by a first shell and a second shell that mate at a seam. The housing includes a cable exit region defining a passage from a cable opening to an interior chamber of the housing. The cable is coupled to and extends from the cable exit region of the housing. A passage segment of the cable is disposed within the housing along the passage. A distal end of the cable is disposed within the interior chamber. The gasket is helically wrapped around the passage segment of the cable and positioned within the cable exit region of the housing. As the first and second shells are mated, the gasket seals the passage between an outer perimeter of the passage segment of the cable and an inner surface of the cable exit region.

20 Claims, 5 Drawing Sheets

CONNECTOR MODULE WITH CABLE EXIT REGION GASKET

BACKGROUND OF THE INVENTION

The subject matter herein relates generally to electrical connector modules that have gaskets at cable exit regions of the connector modules.

In some electrical systems, an electrical connector, such as a plug or a receptacle, includes a cable extending from a housing. The housing holds electrical components, such as electrical contacts or a printed circuit board therein. The cable terminates to the electrical components within the housing. The housing of the electrical connector is configured to mate with a mating connector such that the electrical components within the housing electrically connect to electrical components of the mating connector. When mated to the mating connector, electrical power and/or data signals are transmitted between the electrical components of the mated connectors. The electrical connection between the mated connectors produces electromagnetic interference (EMI) within the housing. Electromagnetic interference is the disruption of operation of an electronic device due to an electromagnetic field caused by electromagnetic induction and/or radiation. The housing of the electrical connector may be configured to contain the EMI to prohibit the EMI from interfering with signal transmissions external to the housing, such as signals transmitted through the portion of the cable outside of the housing and/or other electronic devices in the surrounding environment. However, some known electrical systems fail to contain the EMI within the housing and electrical performance suffers as a result.

For example, EMI may leak through a cable opening in the housing through which the cable is received within the housing for electrical connection to the electrical components therein. The cable opening may be larger than the diameter of the cable such that the EMI leaks through gaps between the cable and the edge of the cable opening. In another example, some known housings are assembled by coupling two shells together, such that each shell defines at least part of the housing. The two shells couple together at a seam. If the two shells are not mated correctly, a gap may form at the seam, and EMI may leak through the gap out of the housing. For example, when assembling the electrical connector, a portion of the cable may get pinched in the seam between the two shells, thereby opening a gap in the seam that allows EMI to escape the housing. A need remains for a connector module that provides better containment of EMI than prior art devices.

BRIEF DESCRIPTION OF THE INVENTION

In one embodiment, a connector module is provided that includes a housing, a cable, and a gasket. The housing is defined by a first shell and a second shell that mate at a seam. An interior chamber of the housing is formed between the first and second shells. The housing includes a cable exit region that defines a passage from a cable opening to the interior chamber. The cable is coupled to and extends from the cable exit region of the housing. A passage segment of the cable is disposed within the housing along the passage. A distal end of the cable is disposed within the interior chamber. The passage segment extends along a cable axis. The gasket extends between a first end and an opposite, second end. The gasket is helically wrapped around the passage segment of the cable and positioned within the cable exit region of the housing. As the first and second shells are mated, the gasket seals the passage between an outer perimeter of the passage segment of the cable and an inner surface of the cable exit region.

In another embodiment, a cable assembly for a connector module is provided that includes a cable and a conductive elastomeric gasket. The cable extends along a cable axis. The cable includes at least one inner conductor, at least one insulation layer surrounding the at least one inner conductor, a conductive shield layer surrounding the at least one insulation layer, and a jacket surrounding the conductive shield layer. An exposed portion of the conductive shield layer is exposed beyond the jacket at an end of the cable. The gasket extends between a first end and an opposite, second end. The gasket is helically wrapped around the exposed portion of the conductive shield layer and electrically engages the conductive shield layer of the cable. The first end is axially spaced apart from the second end along the cable axis. The gasket includes a conductive material embedded therein electrically connected to the conductive shield layer. The conductive material is configured to be electrically connected to a conductive shell of the connector module to electrically common the conductive shield layer with the conductive shell.

In another embodiment, a gasket for a connector module is provided that includes a tube-shaped body extending between first and second ends. The body defines a gasket channel that extends between the first and second ends. The body is compressible inwardly towards the gasket channel. The body is formed of an elastomeric material that includes metal particles embedded therein. The body is wound helically along a longitudinal axis such that the first end is spaced apart axially from the second end along the longitudinal axis. The body has an upper surface configured to engage an upper shell of a housing at multiple points of contact. The body has a lower surface configured to engage a lower shell of the housing at multiple points of contact. The body has an inner surface that defines a cable channel. The cable channel extends along the longitudinal axis. The cable channel is configured to receive a cable therein. The inner surface of the body is configured to engage the cable at multiple points of contact. The body is configured to be at least partially compressed between the upper and lower shells of the housing to seal a gap between the housing and the cable. The metal particles are configured to provide an electrical current path between a conductive shield layer of the cable and the housing.

DETAILED DESCRIPTION OF THE INVENTION

Figure 1:
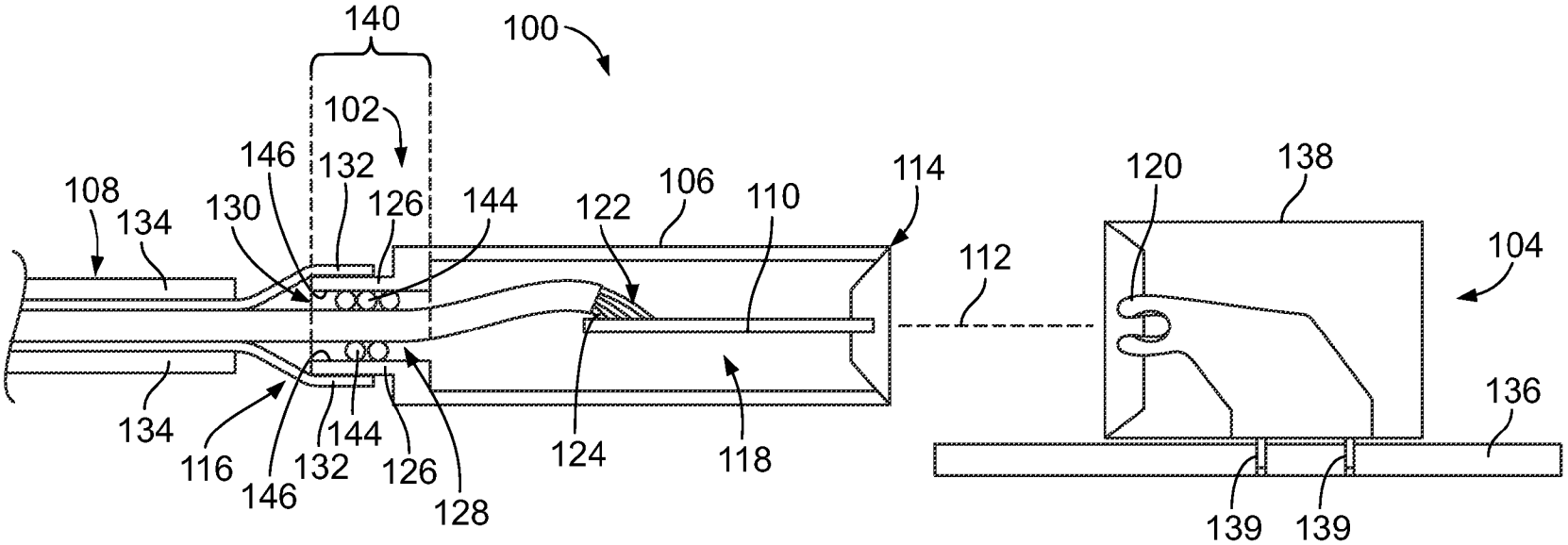
FIG. 1 is a side cross-sectional view of an electrical system in accordance with an embodiment.

FIG. 1 is a side cross-sectional view of an electrical system 100 in accordance with an embodiment. The electrical system 100 includes a connector module 102 and a mating connector 104. The connector module 102 is configured to mate with the mating connector 104 to form an electrical connection that provides a signal path through the connector module 102 and the mating connector 104. The connector module 102 may be a plug, and the mating connector 104 may be a receptacle that accommodates the plug. Alternatively, the connector module 102 is a receptacle, and the mating connector 104 is a plug.

The connector module 102 includes a housing 106, a cable 108, and an electrical component 110. The housing 106 extends along a housing axis 112 between a mating end 114 and a cable end 116. The mating end 114 interfaces with the mating connector 104, and the cable end 116 receives the cable 108. In an alternative embodiment, at least one of the mating end 114 or the cable end 116 is not located along the housing axis 112 of the housing 106. For example, the housing 106 may have a right angle shape instead of an in-line shape. The housing 106 defines an interior chamber 118. The electrical component 110 is held within the interior chamber 118 of the housing 106. The electrical component 110 is configured to electrically connect to a mating electrical component 120 of the mating connector 104. The electrical component 110 in the illustrated embodiment is a circuit card or printed circuit board (PCB). In other embodiments, the electrical component 110 may be or include multiple conductive contacts. The cable 108 terminates to the electrical component 110 to transmit power and/or data signals to and/or from the electrical component 110. For example, the cable 108 may include one or more inner conductors 124 that electrically and mechanically engage contact pads (not shown) or conductive vias (not shown) of the electrical component 110. The inner conductors 124 may define a distal end 122 of the cable 108 that is disposed within the interior chamber 118 of the housing 106. The cable 108 exits the interior chamber 118 via a cable opening 130 at the cable end 116 and extends from the housing 106.

In an embodiment, the housing 106 includes a cable exit region 126. The cable exit region 126 includes the cable end 116 of the housing 106. The cable exit region 126 defines a passage 128 for the cable 108 from the cable opening 130 to the interior chamber 118. A passage segment 140 of the cable 108 is positioned within the passage 128 of the housing 106. The distal end 122 of the cable 108 is distal of the passage segment 140.

The cable exit region 126 provides a structure for coupling the cable 108 to the housing 106. For example, the cable 108 may include a braid 132 that is positioned along an exterior of the cable exit region 126. The braid 132 may be stretched from a non-expanded state within an outer jacket 134 of the cable 108 to an expanded state to position the braid 132 around the cable exit region 126. The braid 132 may be coupled to the cable exit region 126 by crimping a ferrule (not shown) onto the braid 132, by applying an adhesive, or the like, in order to mechanically and electrically connect the cable 108 to the housing 106.

The mating connector 104 includes a housing 138 that holds the mating electrical component 120 therein. In the illustrated embodiment, the mating electrical component 120 of the mating connector 104 includes multiple contacts arranged in an upper and a lower row. The multiple contacts are configured to electrically and mechanically engage corresponding contact pads (not shown) of the electrical component 110 (for example, PCB) of the connector module 102. In other embodiments, the mating electrical component 120 may include other arrangements of contacts or a circuit card instead of contacts. The mating connector 104 may be mounted on a printed circuit board 136. For example, the mating electrical component 120 may include conductive pin contacts 139 that are through-hole mounted to the printed circuit board 136. In other embodiments, the mating connector 104 may be coupled to a cable or a device instead of being mounted to the printed circuit board 136.

The electrical connection formed between the electrical component 110 and the mating electrical component 120 when the connector module 102 and the mating connector 104 are mated may generate electromagnetic interference (EMI). Electromagnetic interference may interfere with and degrade signal transmission along the signal path if the EMI is allowed to leak into and/or out of the housings 106, 138. For example, if EMI is not contained within the housings 106, 138, signal performance of the cable 108 and the PCB 136 may suffer, and signal performance of other devices coupled to or proximate to the cable 108 and/or the PCB 136 may suffer as well. In some known electrical systems, however, the housings fail to effectively contain the EMI, and the performance of the electrical systems suffers as a result.

Embodiments of the inventive subject matter described herein provide connector modules that more effectively restrict EMI leakage through the passage 128 at the cable end 116 of the housing 106, improving signal performance. For example, in one or more embodiments described herein, a gasket 144 may be helically wrapped or wound around the passage segment 140 of the cable 108 within the cable exit region 126 of the housing 106. The gasket 144 is configured to seal the passage 128 by filling the gap between an outer perimeter of the passage segment 140 of the cable 108 and an inner surface 146 of the cable exit region 126. In FIG. 1, the gasket 144 is shown as a plurality of ellipses both above and below the passage segment 140 of the cable 108. In an embodiment, the gasket 144 may be tubular in shape such that, when the gasket 144 is wound around the cable 108 for at least two adjacent loops, the gasket 144 appears as a plurality of adjacent ellipses when viewed in cross-section from a side. As described further herein, the gasket 144 may include a conductive material such that the gasket 144 provides a conductive current path between the passage segment 140 of the cable 108 and the cable exit region 126.

Figure 2:
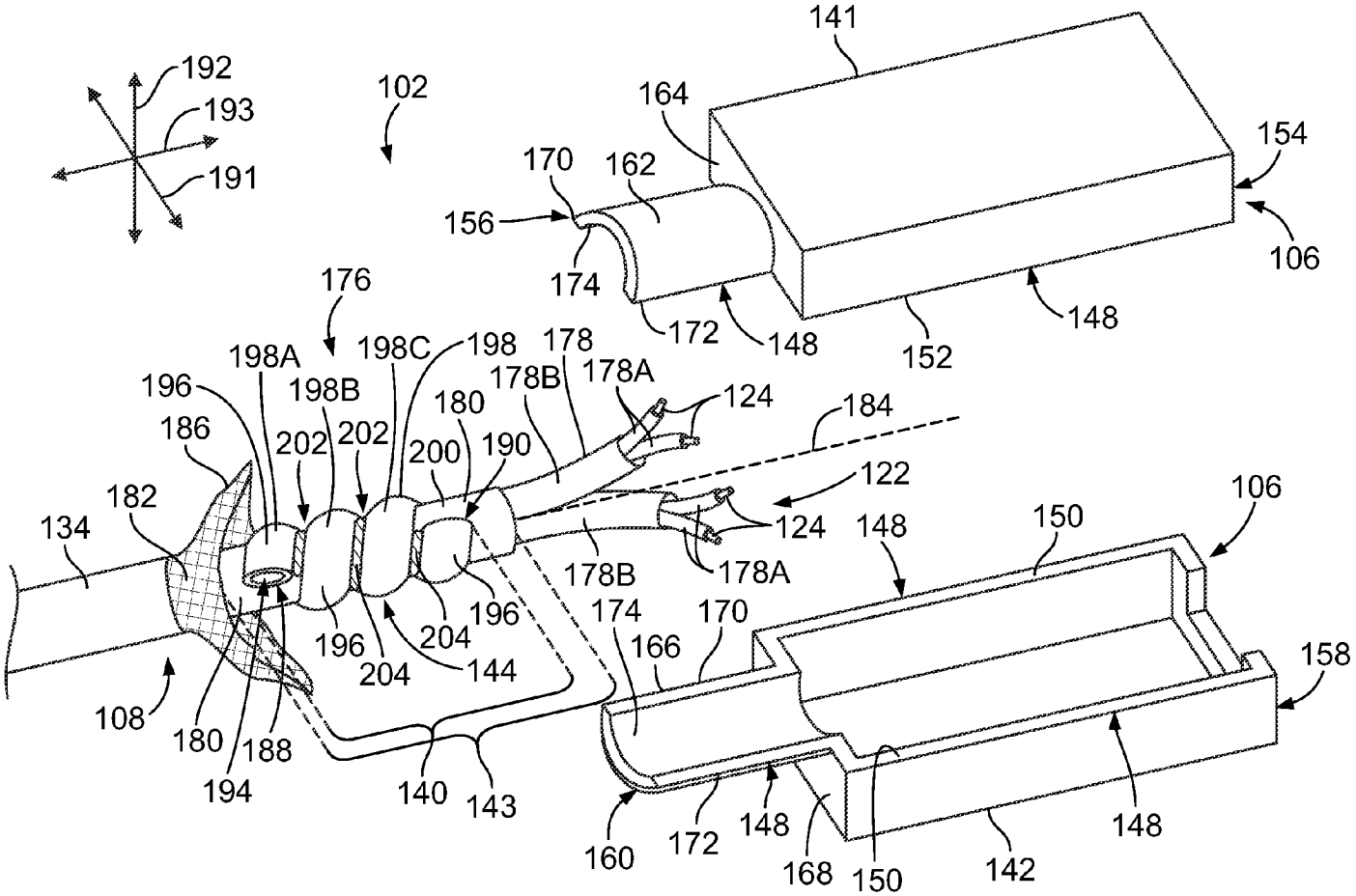
FIG. 2 is an exploded perspective view of a connector module of the electrical system according to an exemplary embodiment.

FIG. 2 is an exploded perspective view of the connector module 102 of the electrical system 100 shown in FIG. 1 according to an exemplary embodiment. The electrical component 110 (shown in FIG. 1) of the connector module 102 is not shown in FIG. 2. The connector module 102 is oriented with respect to a lateral axis 191, an elevation axis 192, and a longitudinal axis 193. The axes 191-193 are mutually perpendicular with respect to one another. Although the elevation axis 192 appears to extend in a vertical direction parallel to gravity in FIG. 2, it is understood that the axes 191-193 are not required to have any particular orientation with respect to gravity.

The housing 106 is defined by a first shell 141 and a second shell 142. The first and second shells 141, 142 mate at a seam 148 to form the assembled housing 106. The interior chamber 118 (shown in FIG. 1) is formed between the mated first and second shells 141, 142. In the illustrated embodiment, the first shell 141 is disposed over the second shell 142. As used herein, the first shell 141 may be referred to as "upper shell" 141, and the second shell 142 may be referred to as "lower shell" 142. Relative or spatial terms such as "upper," "lower," "top," "bottom," "left," or "right" are only used to distinguish the referenced elements and do not necessarily require particular positions or orientations in the electrical system 100 (shown in FIG. 1) or in the surrounding environment of the electrical system 100. The first and second shells 141, 142 may be mated by moving the shells 141, 142 relatively together along the elevation axis 192. The seam 148 may be formed between a top wall 150 of the lower shell 142 and a bottom wall 152 of the upper shell 141. The top wall 150 engages the bottom wall 152 at the seam 148 as the shells 141, 142 are mated.

The upper shell 141 extends between a mating end 154 and a cable end 156. The upper shell 141 includes a cable exit segment 162 that extends from an intermediate wall 164 to the cable end 156. The cable exit segment 162 extends parallel to the longitudinal axis 193. The lower shell 142 also extends between a mating end 158 and a cable end 160. The lower shell 142 includes a cable exit segment 166 that extends from an intermediate wall 168 to the cable end 160. The cable exit segment 166 extends parallel to the longitudinal axis 193. As the upper and lower shells 141, 142 are mated, the mating end 154 of the upper shell 141 aligns with the mating end 158 of the lower shell 142, and the cable end 156 aligns with the cable end 160 to form the housing 106. The cable exit segment 162 of the upper shell 141 aligns with the cable exit segment 166 of the lower shell 142 to define the cable exit region 126 (shown in FIG. 1) of the housing 106.

The cable exit segments 162, 166 each include a left edge 170 and a right edge 172 spaced apart laterally (along the lateral axis 191). The top wall 150 of the lower shell 142 may extend along the cable exit segment 166 at or proximate to each of the left and right edges 170, 172 of the lower shell 142. Likewise, the bottom wall 152 of the upper shell 141 may extend along the cable exit segment 162 at or proximate to each of the left and right edges 170, 172 of the upper shell 141. Each of the cable exit segments 162, 166 includes an inner surface 174 that extends between the left edge 170 and the right edge 172. For example, the inner surface 174 of the lower shell 142 may extend between the top wall 150 at or near the left edge 170 and the top wall 150 at or near the right edge 172. The inner surface 174 of the upper shell 141 may extend between the bottom wall 152 at or near the left edge 170 and the bottom wall 152 at or near the right edge 172. In an embodiment, the inner surfaces 174 are arc-shaped. For example, each inner surface 174 may be concave relative to the edges 170, 172 of the respective cable exit segment 162 or 166, such that the inner surface 174 bows away from the edges 170, 172. When the shells 141, 142 are assembled, the inner surfaces 174 of the cable exit segments 162, 166 combine to define the inner surface 146 (shown in FIG. 1) of the passage 128 extending between the cable end 116 (FIG. 1) and the interior chamber 118 (FIG. 1). In an alternative embodiment, the inner surface 174 of at least one of the cable exit segments 162, 166 is not arc-shaped, but rather may include one or more linear walls, forming a V-shape, a box-shape, or the like. The upper and lower shells 141, 142 may be composed of one or more conductive materials, such as metal. In an embodiment, the shells 141, 142 are formed by a molding process, such as die-casting.

The connector module 102 has a cable assembly 176 that includes at least the cable 108 and the gasket 144 around the cable 108. The cable 108 includes the at least one inner conductor 124, at least one insulation layer 178, at least one conductive shield layer, and the outer jacket 134. The at least one insulation layer 178 surrounds the at least one inner conductor 124, the at least one shield layer surrounds the at least one insulation layer 178, and the outer jacket 134 surrounds the at least one shield layer. In an embodiment, the cable 108 includes an inner shield layer 180 and an outer shield layer 182 that surrounds the inner shield layer 180. The cable 108 extends along a cable axis 184. The cable axis 184 may be parallel to the longitudinal axis 193.

The at least one inner conductor 124 provides a signal path through the cable 108 for electrical signals. In the illustrated embodiment, the cable 108 includes four inner conductors 124. The inner conductors 124 may be composed of metal, such as copper or silver. Optionally, the inner conductors 124 may be organized into two sets of two conductors 124 and configured to convey differential signals. The inner conductors 124 are each individually surrounded by a first insulation layer 178A. Optionally, the insulation layers 178A may be surrounded and enclosed within one of two second insulation layers 178B shown in FIG. 2. The insulation layers 178A, 178B may be formed of a dielectric material, such as plastic to provide electrical insulation and protection for the inner conductors 124. The conductive shield layers 180, 182 provide electrical shielding of the signals traveling through the inner conductors 124. The inner shield layer 180 may be a foil layer formed of a metal foil. The outer shield layer 182 may be a braid similar to the braid 132 (shown in FIG. 1). As used herein, the inner shield layer 180 is referred to as foil layer 180, and the outer shield layer 182 is referred to as braid 182. The braid 182 may include metal strands woven or braided into a layer surrounding the foil layer 180. An end portion 186 of the braid 182 is recessed and stretched to an expanded state for positioning around the cable exit region 126 (shown in FIG. 1) of the housing 106. The outer jacket 134 may be formed of a dielectric material, such as plastic or rubber, to provide electrical insulation, rigidity, and protection of the inner layers of the cable 108 from external forces.

In an embodiment, the passage segment 140 of the cable 108 that is received within the passage 128 (shown in FIG. 1) of the housing 106 defined by the cable exit segments 162, 166 does not include the outer shield layer 182 (for example, the braid 182) or the outer jacket 134. As shown in FIG. 2, an exposed portion 143 of the conductive inner shield layer 180 (for example, the foil layer 180) is exposed beyond the jacket 134 and the braid 182 at or near the end 122 of the cable 108. The outer perimeter of the passage segment 140 of the cable 108 is defined by the foil layer 180 within the exposed portion 143. As such, the gasket 144 surrounds and engages the foil layer 180 of the passage segment 140. The braid layer 182 and the outer jacket 134 do not enter the housing 106. In an alternative embodiment, the braid 182 alone or the braid 182 and the outer jacket 134 both enter the housing 106 as part of the passage segment 140 of the cable 108. For example, the braid 182 may be left over the foil layer 180 along the passage segment 140, and the gasket 144 wraps around and engages the braid 182.

The gasket 144 extends between a first end 188 and an opposite, second end 190. In an embodiment, the gasket 144 has a tubular shape that defines a channel 194 extending between the first and second ends 188, 190. The gasket 144 may be compressible at least radially inward toward the channel 194. For example, a force applied to an outer surface 196 of the gasket 144 in a direction at least partially towards the channel 194 may cause the gasket 144 to deflect inwards at the point of force. The gasket 144 may have a circular or elliptical (for example, oval) cross-section. In an alternative embodiment, the gasket 144 may be solid without defining a channel, but may still be compressible radially inward.

In an exemplary embodiment, the gasket 144 is helically wrapped around the passage segment 140 of the cable 108. For example, the gasket 144 curves around the passage segment 140 and also extends longitudinally along the cable axis 184 such that the first end 188 is spaced apart axially from the second end 190. The gasket 144 engages the exposed portion 143 of the foil layer 180 that defines the outer perimeter of the passage segment 140. The passage segment 140 of the cable 108 need not have a circular cross-section. But, assuming for example the passage segment 140 does have a circular cross-section, the gasket 144 may curve around the passage segment 140 with a constant radius, forming a circular helix.

The gasket 144 wraps fully around the outer perimeter of the passage segment 140 to form a loop 198. The gasket 144 may include at least one loop 198. In some embodiment, the gasket 144 includes at least two loops 198. In the illustrated embodiment, the gasket 144 includes three loops 198A, 198B, and 198C. Each loop 198 is defined when a section of the gasket 144 extends adjacent to another section of the gasket 144 at the same circumferential location of the passage segment 140. As shown in FIG. 2, the three loops 198A-C extend adjacent to each other at an upper circumferential location 200 of the passage segment 140 ("upper" relative to the elevation axis 192). Each loop 198 wraps around and engages the foil layer 180 of the cable 108. For example, since the gasket 144 is helically wrapped and extends along the cable axis 184, each loop 198 engages the foil layer 180 at a different axial location along the cable axis 184.

Optionally, the outer surface 196 of each loop 198 may abut the outer surface 196 of an adjacent loop 198. Alternatively, adjacent loops 198 may be spaced apart by a space or interstice 202. For example, although the loops 198 may be spaced apart as part of the cable assembly 176 prior to being loaded into the housing 106, once the gasket 144 is compressed by the mating of the upper and lower shells 141, 142, the interstices 202 between the loops 198 may narrow or disappear, such that the outer surfaces 196 of adjacent loops 198 abut each other.

In an embodiment, the helical shape of the gasket 144 may be retained by securing adjacent loops 198 to each other and/or by securing the gasket 144 to the foil layer 180. For example, as shown in FIG. 2, each loop 198 is secured to an adjacent loop 198 by an adhesive 204 disposed between the two loops 198. The adhesive 204 may be a hot melt glue or the like. The adhesive 204 may be applied directly to the outer surfaces 196 of the loops 198. In another embodiment, an adhesive may be used to secure at least the ends 188, 190 of the gasket 144 to the foil layer 180 to hold the positions of the ends 188, 190 relative to the foil layer 180. The gasket 144 may be secured to the passage segment 140 of the cable 108 using other than adhesives, such as by providing the gasket 144 with a rigid material that allows the gasket 144 to independently retain the helical shape.

The gasket 144 may be formed of an elastomeric material that allows the gasket 144 to be coiled in the helical shape and compress. In an exemplary embodiment, the gasket 144 also includes a conductive material embedded therein or coated thereon. For example, the gasket 144 may include metal particles, such as silver or nickel. The particles may be metal plated. Optionally, the metal particles may be contained in a paint or coating that is applied to the surface of the gasket 144. The conductive material allows the gasket 144 to be electrically conductive. As described further herein, the conductive material of the gasket 144 electrically connects to a conductive shield layer (for example, the foil layer 180). The conductive material is also configured to be electrically connected to a conductive shell (for example, the upper shell 141 and/or the lower shell 142) of the connector module 102. The gasket 144 thus may provide an electrical current path between the conductive shell and the conductive shield layer, which electrically commons the conductive shield layer with the conductive shell.

In an embodiment, the connector module 102 is assembled by inserting the cable 108 in the upper shell 141 or the lower shell 142, and mating the two shells 141, 142 to entrap the passage segment 140 of the cable 108 between the cable exit segments 162, 166. The gasket 144 helically wrapped around the passage segment 140 is also received and entrapped between the cable exit segments 162, 166.

In some known electrical systems that include electrical connectors assembled by joining two shells, at least a portion of the cable may be pinched at the seam between the shells during the assembly process. The force applied on the cable at the seam may damage the cable. In addition, the material of the cable sandwiched between the shells prohibits the shells from flush engagement at the seam, producing one or more gaps along the seam. The gaps may allow the release of EMI from the housing (as well as allowing externally-produced EMI to enter the housing), reducing the performance of the electrical system.

Referring back to FIG. 2, the gasket 144 radially surrounds the cable 108 and prohibits the cable 108 from interfering with the mating of the upper and lower shells 141, 142 at the seam 148. In addition, the gasket 144 is configured to not interfere with the mating of the shells 141, 142 at the seam 148. For example, the gasket 144 winds around the cable axis 184, so the gasket 144 curves away from the seam 148 at the edges 170, 172 of the cable exit segments 162, 166. In addition, when compressed, the tubular gasket 144 may at least partially flatten such that the loops 198 become wider and the first and second ends 188, 190 of the gasket 144 extend further apart along the cable axis 184. However, the gasket 144 under compression is not likely to extend radially into the seam 148 between the upper and lower shells 141, 142. Furthermore, the gasket 144 seals the passage 128 (shown in FIG. 1) formed between the cable exit segments 162, 166. The gasket 144 fills any voids or spaces between the outer perimeter of the passage segment 140 of the cable 108 and the inner surfaces 174 of the cable exit segments 162, 166 to restrict EMI leakage through the passage 128 both into and out from the interior chamber 118 (shown in FIG. 1) of the housing 106. For example, the gasket 144 provides an electrical current path between the housing 106 and the foil layer 180 of the cable 108, which shields against EMI leakage. As such, one or more embodiments of the connector module 102 restricts EMI leakage through the cable opening 130 (shown in FIG. 1) of the housing 106 by using the gasket 144 helically-wrapped around the cable 108 to seal the cable opening 130 and provide an unobstructed seam 148 between the shells 141, 142 of the housing 106.

Figure 3:
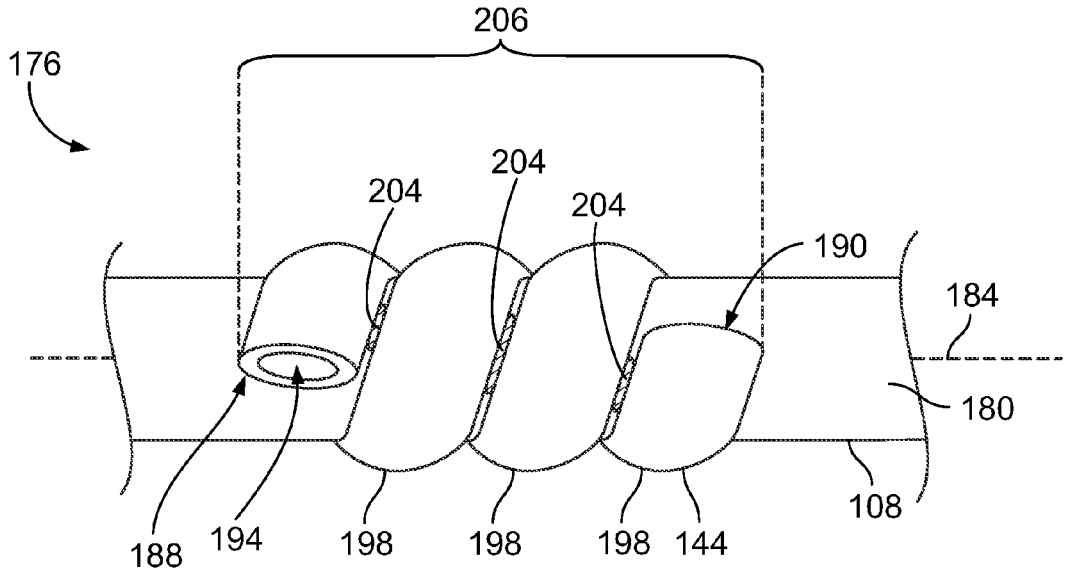
FIG. 3 is a side view of a portion of a cable assembly of the connector module according to an exemplary embodiment.

FIG. 3 is a side view of a portion of the cable assembly 176 of the connector module 102 (shown in FIGS. 1 and 2) according to an exemplary embodiment. The portion of the cable assembly 176 shown in FIG. 3 includes the gasket 144 helically wrapped around the foil layer 180 of the passage segment 140 (shown in FIG. 2) of the cable 108. In FIG. 3, the cable assembly 176 is not within the housing 106 (shown in FIGS. 1 and 2) of the connector module 102. The gasket 144 is not compressed between the upper and lower shells 141, 142 (shown in FIG. 2) of the housing 106, so the gasket 144 is in an uncompressed state. The loops 198 of the helically-wound gasket are secured to each other by the adhesive 204 located between adjacent loops 198. The first end 188 of the gasket 144 is separated from the second end 190 along the cable axis 184 by a first uncompressed length 206.

Figure 4:
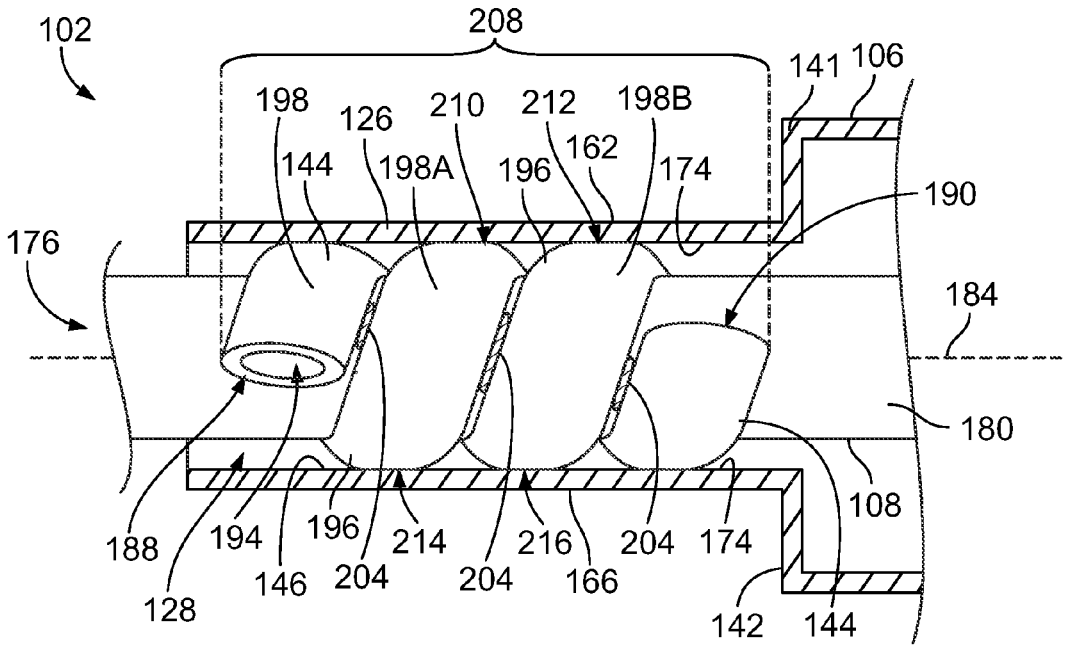
FIG. 4 is a side view of a portion of the connector module showing the cable assembly of FIG. 3 within a housing.

FIG. 4 is a side view of a portion of the connector module 102 showing the cable assembly 176 of FIG. 3 within the housing 106. The housing 106 is shown in cross-section in FIG. 4 for illustrative purposes to show an unobstructed view of the cable assembly 176 within the housing 106. The housing 106 includes the cable exit region 126, defined by the cable exit segment 162 of the upper shell 141 and the cable exit segment 166 of the lower shell 142. The gasket 144 and the cable 108 surrounded by the gasket 144 are disposed within the passage 128 of the cable exit region 126. In an exemplary embodiment, the passage 128 has a cross-sectional area (or a diameter) that is at least slightly smaller than a cross-sectional area (or a diameter) of the gasket 144 wrapped around the cable 108 in the uncompressed state (shown in FIG. 3). As such, upon mating the upper and lower shells 141, 142, the gasket 144 is at least partially compressed. For example, the inner surfaces 174 of the upper and lower shells 141, 142 apply a force on the outer surfaces 196 of the gasket 144, which causes the gasket 144 to be sandwiched between the inner surfaces 174 and the outer perimeter (for example, the foil layer 180) of the cable 108. As a result, the gasket 144 is deformed to a compressed state.

As shown in FIG. 4, in the compressed state, the channel 194 of the gasket 144 may be more oblong than the channel 194 in the uncompressed state shown in FIG. 3. In addition, the loops 198 of the gasket 144 in the compressed state may be longer (occupying more space along the cable axis 184) than the loops 198 of the gasket 144 in the uncompressed state, due to the flattening of the tubular gasket 144. Since the loops 198 are secured directly to each other by the adhesive 204, the spacing between the loops 198 may not increase although the individual widths of the loops 198 increase with compression. If there were any gaps between the loops 198 in the uncompressed state, the flattening caused by compression may reduce or eliminate the gaps between the loops 198. Although changes in the spacing between the loops 198 is restricted during compression due to the adhesive 204 between the loops 198, compression of the gasket 144 may increase the axial length of the gasket 144. For example, the first end 188 of the gasket 144 in the compressed state is axially separated from the second end 190 along the cable axis 184 by a first compressed length 208. The compressed length 208 is greater than the uncompressed length 206 of the gasket 144 shown in FIG. 3. Therefore, as the gasket 144 is compressed by the housing 106, the gasket 144 may extend further along the cable axis 184 than the gasket 144 in the uncompressed state.

The loops 198 provide multiple points of contact with the upper and lower shells 141, 142 of the housing 106. For example, the loop 198A shown in FIG. 4 engages the inner surface 174 of the upper shell 141 at a first upper point of contact 210 and engages the inner surface 174 of the lower shell 142 at a first lower point of contact 214. The loop 198B engages the inner surface 174 of the upper shell 141 at a second upper point of contact 212 and engages the inner surface 174 of the lower shell 142 at a second lower point of contact 216. The first and second upper points of contact 210, 212 are spaced apart axially (along the cable axis 184). The first and second lower points of contact 214, 216 are likewise spaced apart axially (along the cable axis 184).

The compression of the gasket 144 by the housing 106 allows the gasket 144 to seal the passage 128 between the foil layer 180 (forming the outer perimeter) of the cable 108 and the inner surface 146 of the cable exit region 126 (defined by the inner surfaces 174). The sealing of the passage 128 restricts EMI leakage through the passage 128 into and/or out of the interior chamber 118 (shown in FIG. 1). The gasket 144 includes conductive material embedded therein. The engagement of both the inner surface 146 of the cable exit region 126 and the conductive foil layer 180 of the cable 108 allows the gasket 144 to provide an electrical current path between the housing 106 and the cable 108. In addition, the redundancy provided by the gasket 144 having multiple loops 198 engaging the housing 106 and the cable 108 at multiple points of contact may increase shielding and improve EMI containment.

Figure 5:
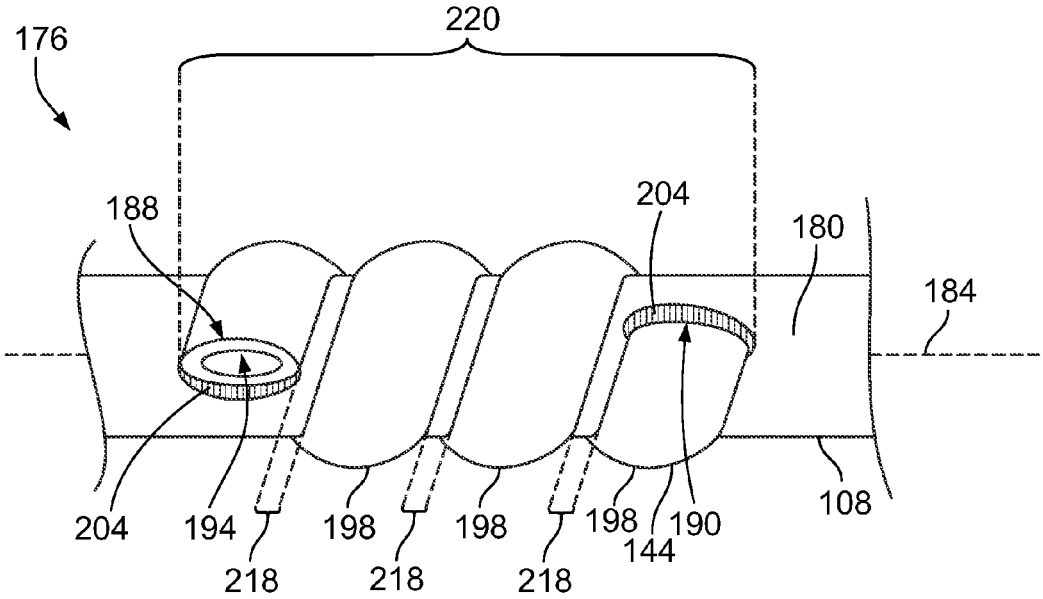
FIG. 5 is a side view of a portion of a cable assembly of the connector module according to another embodiment.

FIG. 5 is a side view of a portion of the cable assembly 176 of the connector module 102 (shown in FIGS. 1 and 2) according to another embodiment. Like FIG. 3, the portion of the cable assembly 176 shown in FIG. 5 includes the gasket 144 helically wrapped around the foil layer 180 of the passage segment 140 (shown in FIG. 2) of the cable 108. The cable assembly 176 is not within the housing 106 (shown in FIGS. 1 and 2) of the connector module 102, so the gasket 144 is in the uncompressed state. The first and second ends 188, 190 of the gasket 144 are each secured to the foil layer 180 (forming the outer perimeter of the cable 108) by the adhesive 204. Securing the ends 188, 190 relative to the foil layer 180 retains the helical winding of the gasket 144 and prohibits the first and second ends 188, 190 from moving relative to the foil layer 180 of the cable 108. The first end 188 of the gasket 144 is separated from the second end 190 along the cable axis 184 by a second uncompressed length 220. In the illustrated embodiment, the loops 198 of the gasket 144 are not secured to each other so the loops 198 may move relative to each other. Adjacent loops 198 may be separated from each other by a loop spacing 218. The loop spacing 218 between each pair of adjacent loops 198 may not have a uniform dimension (in the direction along the cable axis 184).

Figure 6:
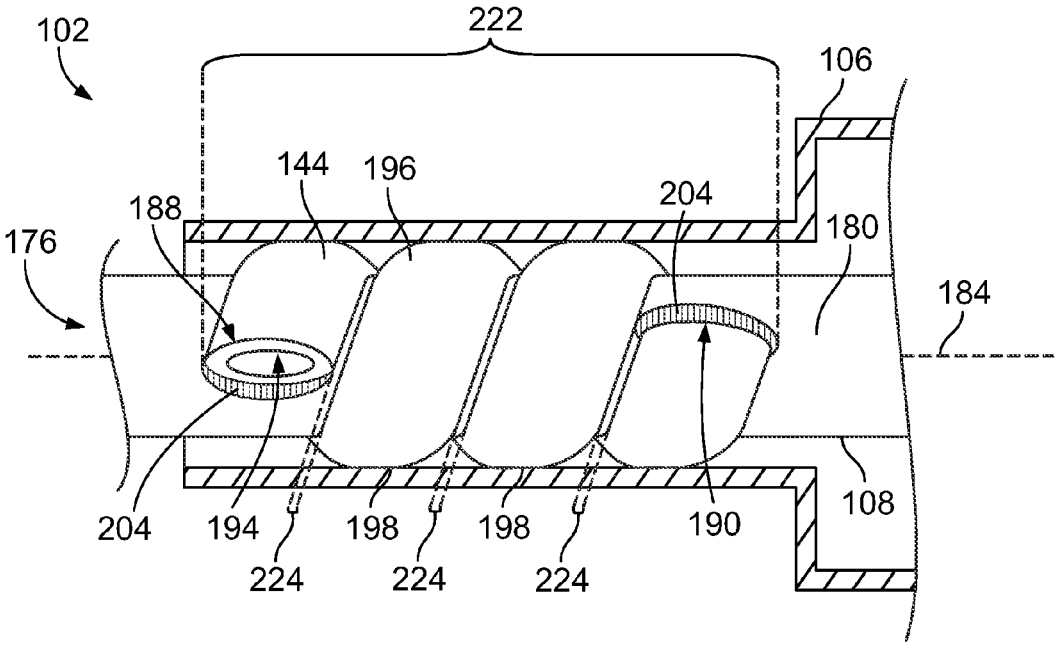
FIG. 6 is a side view of a portion of the connector module showing the cable assembly of FIG. 5 within a housing.

FIG. 6 is a side view of a portion of the connector module 102 showing the cable assembly 176 of FIG. 5 within the housing 106. Like FIG. 4, the housing 106 is shown in cross-section in FIG. 6 for an unobstructed view of the cable assembly 176 within the housing 106. The gasket 144 is compressed to a compressed state due to forces exerted on the gasket 144 by the housing 106 outside of the helically-wrapped gasket 144 and by the cable 108 within the helically-wrapped gasket 144. In the compressed stated, the channel 194 may be more oblong than the channel 194 shown in FIG. 5, and the loops 198 may be longer (along the cable axis 184) than the loops 198 shown in FIG. 5. Since the ends 188, 190 of the gasket 144 are secured to the foil layer 180 of the cable 108 by the adhesive 204, the distance between the ends 188, 190 may not change during the transition from the uncompressed state to the compressed state. For example, in FIG. 6 the first end 188 of the gasket 144 is axially separated from the second end 190 along the cable axis 184 by a second compressed length 222. The second compressed length 222 may be equal to the second uncompressed length 220 shown in FIG. 5. Although the ends 188, 190 are fixed, as the loops 198 flatten due to the compression, a loop spacing 224 between adjacent loops 198 may decrease. For example, the loop spacing 224 in the compressed state (FIG. 6) may be smaller than the loop spacing 218 in the uncompressed state (FIG. 5). Optionally, the loops 198 may compress to the extent that no loop spacing exists between adjacent loops 198, and the outer surfaces 196 of adjacent loops 198 engage each other.

Figure 7:
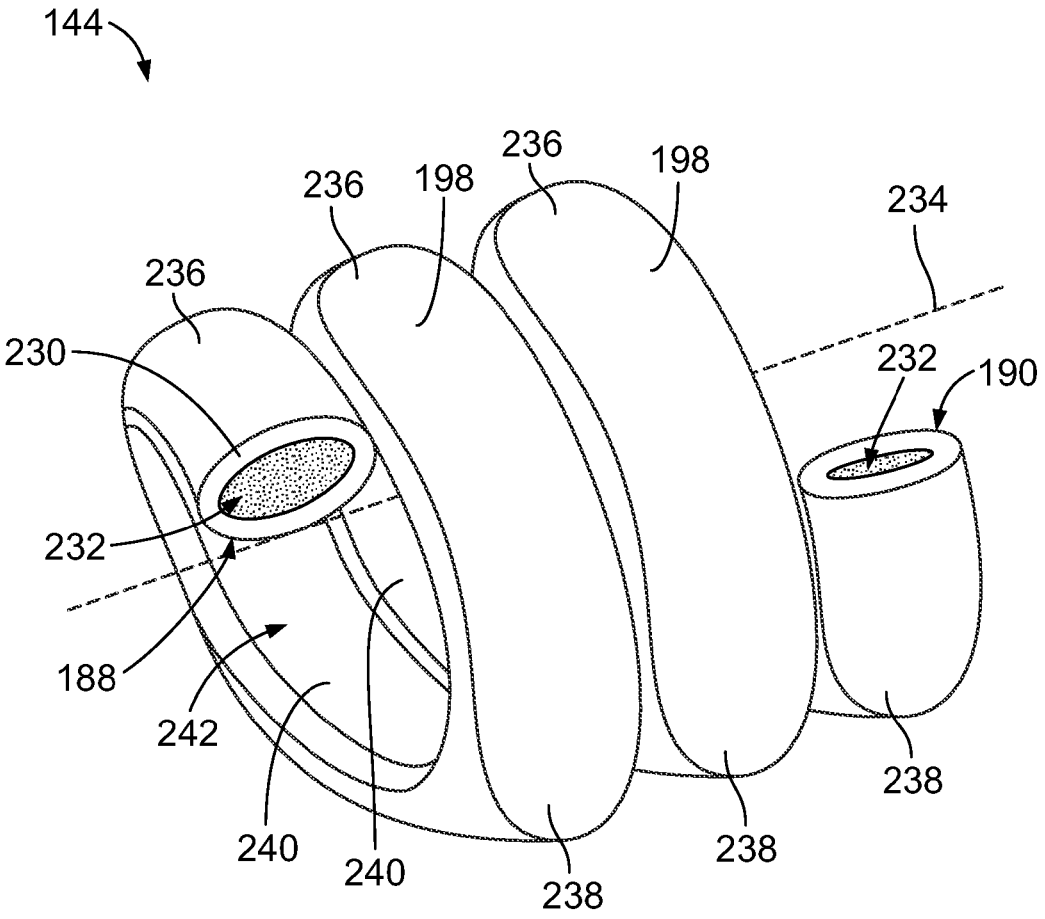
FIG. 7 is a perspective view of a gasket for the connector module according to an exemplary embodiment.

FIG. 7 is a perspective view of the gasket 144 for the connector module 102 (shown in FIGS. 1 and 2) according to an exemplary embodiment. The gasket 144 has a tube-shaped body 230 that extends between the first end 188 and the second end 190. The tube-shape of the body 230 may have an elliptical or rectangular cross section. The body 230 may be hollow and define a gasket channel 232 that extends between the first and second ends 188, 190. The gasket channel 232 may be the channel 194 shown in FIG. 2. The body 230 is compressible radially inwards toward the gasket channel 232. Alternatively, the body 230 may be solid and formed of compressible foam. The body 230 is wound helically around a longitudinal axis 234. The longitudinal axis 234 may be parallel to the cable axis 184 (shown in FIG. 2) of the cable 108 (FIG. 2). In an embodiment, the first end 188 is spaced apart axially from the second end 190 along the longitudinal axis 234. The body 230 forms two loops 198 that are spaced axially along the longitudinal axis 234.

The body 230 has an upper surface 236 that is configured to engage the upper shell 141 (shown in FIG. 2) of the housing 106 (FIG. 2) at multiple points of contact. The body 230 has a lower surface 238 configured to engage the lower shell 142 (shown in FIG. 2) of the housing 106 at multiple points of contact. The upper and lower surfaces 236, 238 may rotate or otherwise change based on the orientation of the body 230 relative to the upper and lower shells 141, 142. The body 230 further includes an inner surface 240 that defines a cable channel 242. The cable channel 242 extends along the longitudinal axis 234. The cable channel 242 is configured to receive the cable 108 (shown in FIG. 2) therein. The inner surface 240 of the body 230 is configured to engage the cable 108 at multiple points of contact. The body 230 is configured to be at least partially compressed between the upper and lower shells 141, 142 of the housing 106 to seal a gap between the housing 106 and the cable 108.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A connector module comprising:

a housing defined by a first shell and a second shell that mate at a seam, an interior chamber within the housing is formed between the first and second shells, the housing includes a cable exit region that defines a passage from a cable opening to the interior chamber;

a cable coupled to and extending from the cable exit region of the housing, a passage segment of the cable disposed within the housing along the passage, a distal end of the cable disposed within the interior chamber; and a gasket extending between a first end and an opposite, second end, the gasket helically wrapped around the passage segment of the cable and positioned within the cable exit region of the housing, wherein, as the first and second shells are mated, the gasket seals the passage between an outer perimeter of the passage segment of the cable and an inner surface of the cable exit region.

2. The connector module of claim 1, wherein the outer perimeter of the passage segment of the cable is a conductive foil layer, the first and second shells of the housing are formed of metal, and the gasket includes a conductive material, the gasket providing an electrical current path between the inner surface of the cable exit region and the foil layer of the cable.

3. The connector module of claim 1, wherein the gasket has a tubular shape that defines a channel between the first and second ends, the gasket being compressible inwardly toward the channel, an interior diameter of the cable exit region being smaller than a diameter of the gasket wrapped around the passage segment of the cable such that the gasket at least partially compresses as the first and second shells are mated.

4. The connector module of claim 3, wherein, when the first and second shells are un-mated, the first end of the gasket is axially separated from the second end of the gasket along a longitudinal axis by a first length, and, when the first and second shells are mated and the gasket is at least partially compressed, the first end of the gasket is axially separated from the second end along the longitudinal axis by a second length that is greater than the first length.

5. The connector module of claim 1, wherein the gasket is helically wrapped around the passage segment of the cable to form at least two loops spaced axially along a longitudinal axis such that the first end of the gasket is spaced apart axially from the second end of the gasket, each loop wrapping around and engaging the outer perimeter of the passage segment of the cable, the at least two loops providing multiple points of contact with the first shell of the housing and multiple points of contact with the second shell.

6. The connector module of claim 5, wherein an outer surface of each loop abuts the outer surface of an adjacent loop.

7. The connector module of claim 5, wherein each loop is coupled to an adjacent loop by an adhesive disposed between the two loops, the adhesive retaining the helical shape of the gasket.

8. The connector module of claim 1, wherein the first and second ends of the gasket are secured to the outer perimeter of the passage segment of the cable by an adhesive to prohibit the first and second ends of the gasket from separating from the cable.

9. The connector module of claim 1, wherein the gasket is formed of an elastomeric material that includes at least one of nickel or silver particles embedded therein.

10. The connector module of claim 1, wherein a foil layer defines the outer perimeter of the passage segment of the cable within the housing, the cable further including a braid surrounding the foil layer, the braid extending around the cable exit region of the housing and coupled thereto to mechanically and electrically connect the cable to the housing.

11. The connector module of claim 1, wherein the gasket includes a conductive material, the gasket sealing the passage between the outer perimeter of the passage segment of the cable and the inner surface of the cable exit region to restrict electromagnetic interference (EMI) leakage through the passage.

12. A cable assembly for a connector module comprising:

a cable extending along a cable axis, the cable including at least one inner conductor, at least one insulation layer surrounding the at least one inner conductor, a conductive shield layer surrounding the at least one insulation layer, and a jacket surrounding the conductive shield layer, wherein an exposed portion of the conductive shield layer is exposed beyond the jacket at an end of the cable; and a conductive elastomeric gasket extending between a first end and an opposite, second end, the gasket helically wrapped around the exposed portion of the conductive shield layer and electrically engaging the conductive shield layer of the cable, the first end being axially spaced apart from the second end along the cable axis, the gasket including a conductive material embedded therein electrically connected to the conductive shield layer, the conductive material being configured to be electrically connected to a conductive shell of the connector module to electrically common the conductive shield layer with the conductive shell.

13. The cable assembly of claim 12, wherein the gasket is helically wrapped around the exposed portion of the conductive shield layer to form at least two loops, each loop engaging the conductive shield layer at a different axial location along the cable axis.

14. The cable assembly of claim 13, wherein an outer surface of each loop abuts the outer surface of an adjacent loop.

15. The cable assembly of claim 13, wherein each loop is coupled to an adjacent loop by an adhesive disposed between outer surfaces of the adjacent loops, the adhesive retaining the helical shape of the gasket.

16. The cable assembly of claim 12, wherein the first and second ends of the gasket are secured to the conductive shield layer of the cable by an adhesive to prohibit the first and second ends of the gasket from separating from the cable.

17. The cable assembly of claim 12, wherein the gasket is compressible.

18. The cable assembly of claim 12, wherein the conductive material of the gasket includes at least one of nickel or silver.

19. A gasket for a connector module comprising:

a tube-shaped body extending between first and second ends, the body defining a gasket channel that extends between the first and second ends, the body compressible inwardly towards the gasket channel, the body formed of an elastomeric material that includes metal particles embedded therein, the body wound helically around a longitudinal axis such that the first end is spaced apart axially from the second end along the longitudinal axis, the body having an upper surface configured to engage an upper shell of a housing at multiple points of contact, the body having a lower surface configured to engage a lower shell of the housing at multiple points of contact, the body having an inner surface that defines a cable channel extending along the longitudinal axis, the cable channel configured to receive a cable therein, the inner surface of the body configured to engage the cable at multiple points of contact, the body configured to be at least partially compressed between the upper and lower shells of the housing to seal a gap between the housing and the cable, the metal particles configured to provide an electrical current path between a conductive shield layer of the cable and the housing.

20. The gasket of claim 19, wherein the body is wound helically around the longitudinal axis to form at least two loops spaced axially along the longitudinal axis, each of the loops being coupled to an adjacent loop by an adhesive to retain the helical shape of the body.

* * * * *